United States Patent [19]

King

[11] 4,168,599

[45] Sep. 25, 1979

[54] PACKAGING SYSTEM

[75] Inventor: James F. King, Winston-Salem, N.C.

[73] Assignee: Hanes Corporation, Winston-Salem, N.C.

[21] Appl. No.: 908,231

[22] Filed: May 22, 1978

[51] Int. Cl.[2] ..... B65B 5/04; B65B 7/28

[52] U.S. Cl. ..... 53/471; 53/173; 53/253; 53/282; 53/314; 53/485; 53/529; 141/146

[58] Field of Search ..... 53/467, 471, 485, 173, 53/281, 282, 314, 276, 253, 527, 529; 198/480, 656, 803; 141/145, 146

[56] References Cited

U.S. PATENT DOCUMENTS

| | | | |
|---|---|---|---|
| 2,897,643 | 8/1959 | Byrd | 53/281 X |
| 3,190,055 | 6/1965 | Povlacs | 53/282 |
| 3,517,480 | 6/1970 | Pinkham | 53/282 X |
| 3,552,454 | 1/1971 | Deming | 141/146 X |
| 3,707,825 | 1/1973 | Bell et al. | 53/282 |

FOREIGN PATENT DOCUMENTS

| | | | |
|---|---|---|---|
| 2048948 | 4/1971 | Fed. Rep. of Germany | 53/282 |

*Primary Examiner*—Travis S. McGehee

*Attorney, Agent, or Firm*—Charles Y. Lackey; William S. Burden

[57] ABSTRACT

A system for packaging articles within containers, each including a lower article receiving portion, wherein a plurality of container receivers are continuously rotated in an endless path and displaced radially of their axis of rotation to various work zones. Each of the receivers is provided with a loading tube and a ram for positioning an article within a container lower receiving portion, and dispensing means are provided for rotating and accurately positioning the container lower portion within the receiver, and for positioning an upper lid or cap portion with respect to the lower container portion.

19 Claims, 14 Drawing Figures

PACKAGING SYSTEM

BRIEF SUMMARY AND OBJECTS OF THE INVENTION

This invention relates generally to the packaging of articles, and more particularly to the continous packaging of hosiery articles, within containers including lower article receiving portions closed by a lid or cap.

While the invention is particularly well adapted for packaging hosiery articles such as panty hose garments, tights, etc., as well as conventional stockings, knee high hosiery and the like, the invention is not limited to the packaging of such garments but may have application in the packaging of various other materials or articles.

The particular containers utilized for receiving the articles, for convenience, will be described with respect to an egg-shaped container having a lower egg half or article receiving portion for receiving one or more articles and an upper egg half or cap portion which cooperates with the lower egg half, acting as a cover or lid for encompassing the article or garment. However, it is to be emphasized that containers of various sizes and configurations may be utilized without departing from the scope of the invention, and references to upper and lower portions are intended to include the cooperating generally egg-shaped containers as well as containers which include a lower article receiving portion which may be closed by a lid or cover.

The present invention enables packaging of a wide range of articles, particularly textile articles, in an unfolded, crinkled condition.

Briefly, the apparatus of the present invention includes a carrier disk, a plurality of loading tubes, and a like number of rams, pivotably mounted upon a spider arrangement, and all continuously rotatable together as a unit. Assemblies for dispensing the lower and upper portions of the containers, an article loading zone, an assembly for applying cardboard cylinders to the containers, and a discharge station are provided in spaced relation about the periphery of the rotatable unit. The carrier disk slidably supports a series of spaced receivers, the receivers being displaced radially of the axis of the carrier disk upon rotating of the disk along a path having segments defined by circles of different diameters. A ram and loading tube are provided for each receiver. The assemblies for removing sequentially the container portions and directing them towards the receivers include clamps for initiating displacement of the lowermost container portion from a plurality of container portions stacked in nested relation within supply hoppers.

The word package as used herein, is intended to include any container suitable for receiving and retaining one or more articles.

One of the primary objects of the invention is the provision of a packaging system which permits automatic packaging of various articles.

Another object of the invention is the provision of an apparatus for packaging sequentially a plurality of flexible textile articles as they are displaced in an arcuate path.

A further object of the invention is the provision of a fast acting and reliable automatic machine for packaging the articles while eliminating damage to the articles.

Other objects and advantages of the invention will become apparent when considered in view of the following detailed description.

DETAILED DESCRIPTION OF THE INVENTION

The present invention is directed to the automatic packaging of articles in containers which includes positioning one or more articles within containers lower portions or egg halves as they are displaced in an arcuate path and preferably enclosing the articles by applying an upper egg half or cover portion to the lower portion.

Figure 1:
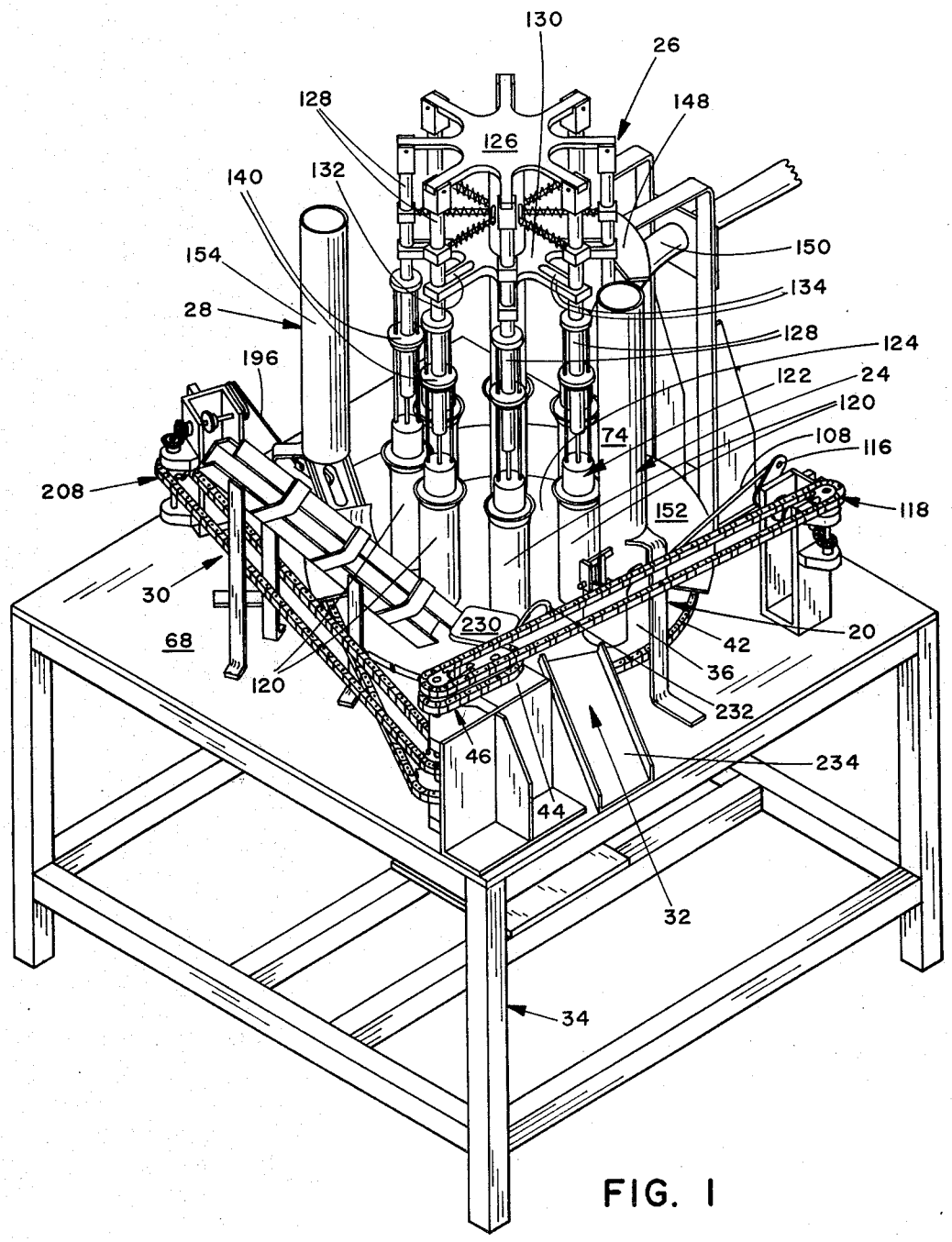
FIG. 1 is a perspective view of one embodiment of the packaging apparatus of the present invention.
Figure 2:
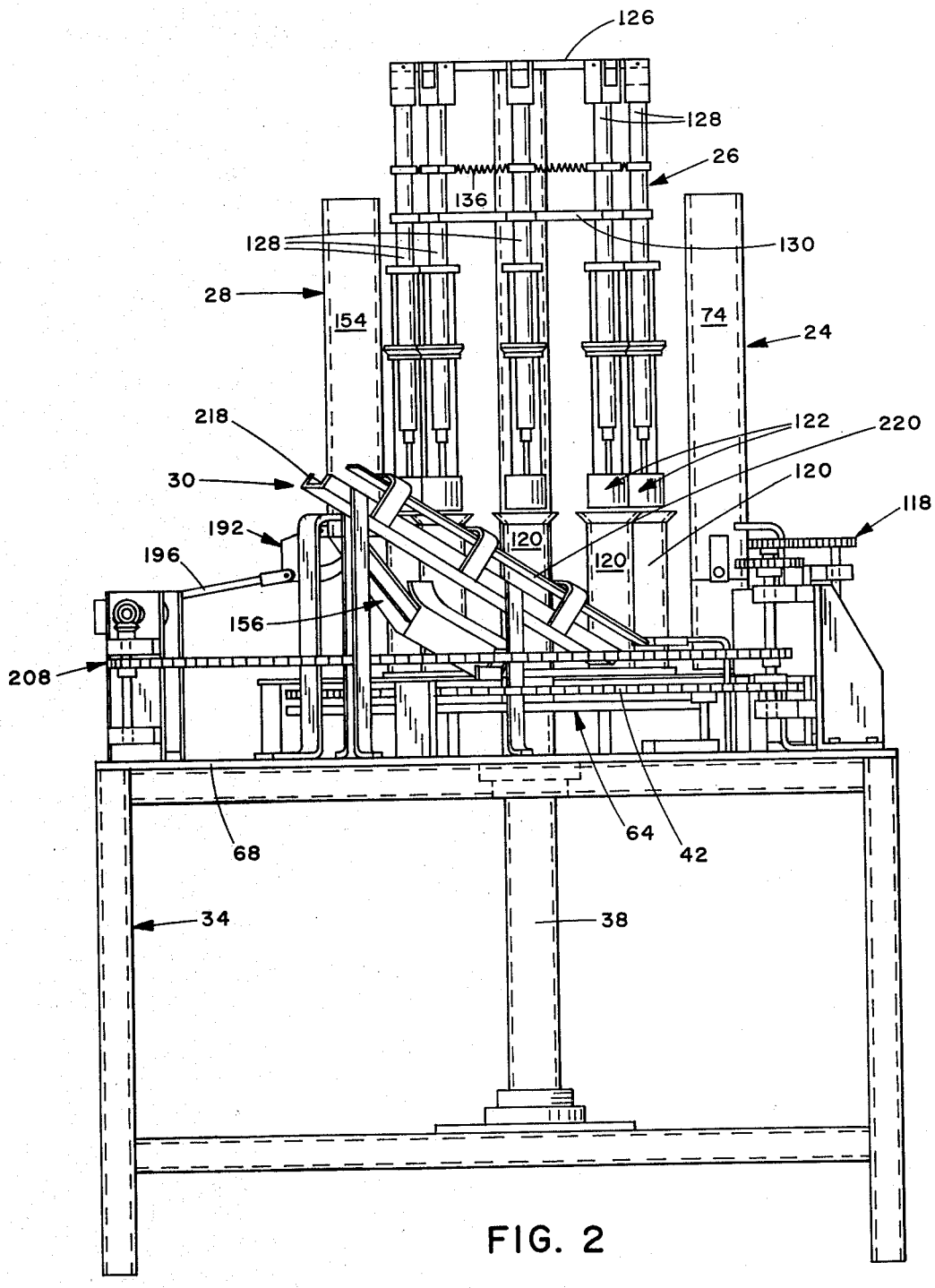
FIG. 2 is a side elevational view of the apparatus of FIG. 1.
Figure 3:
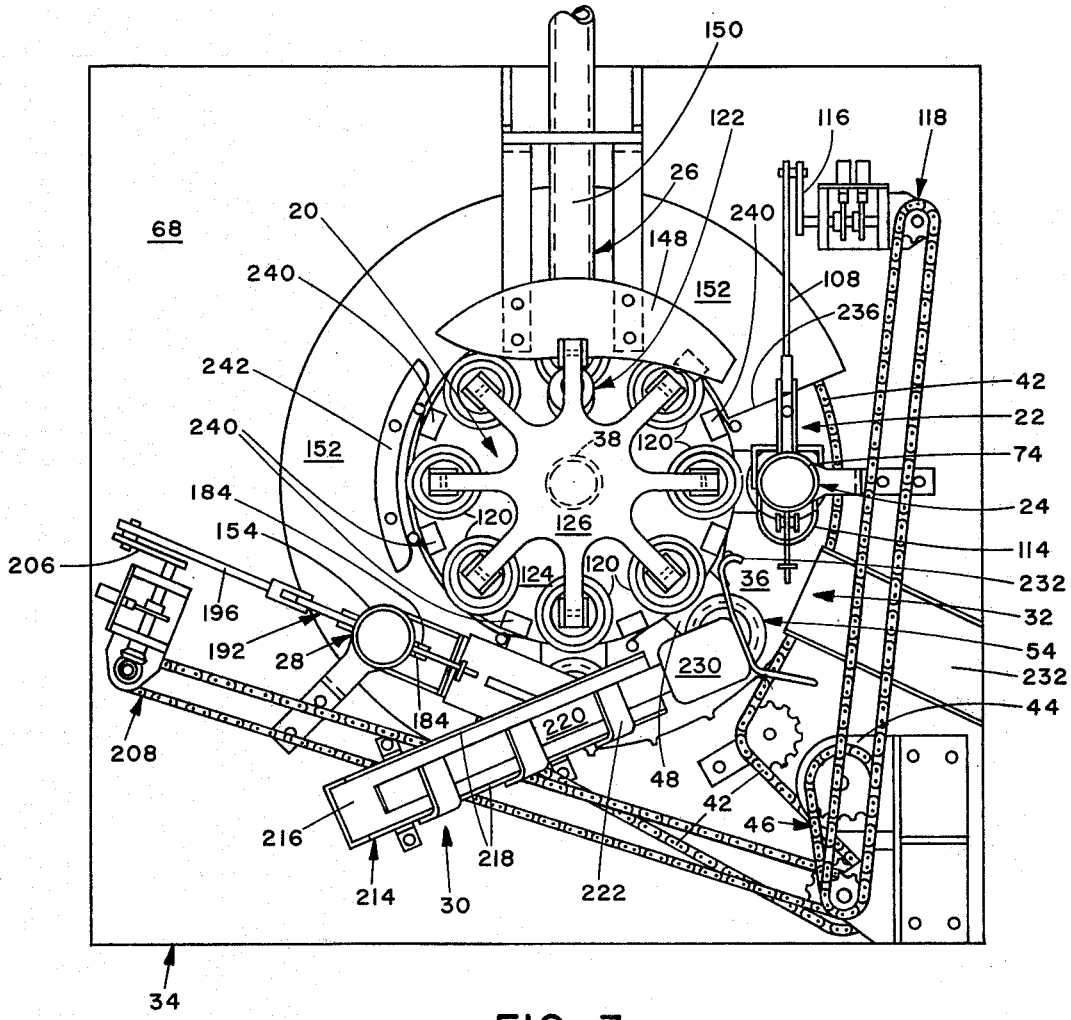
FIG. 3 is a top plan view of the apparatus of FIG. 2.

Referring particularly to FIGS. 1–3, a carrier assembly 20, a dispensing assembly 24, a loading assembly 26, a dispensing assembly 28, a cardboard loading assembly 30 and a package ejection assembly 32 all are mounted upon a support structure 34.

Figure 4:
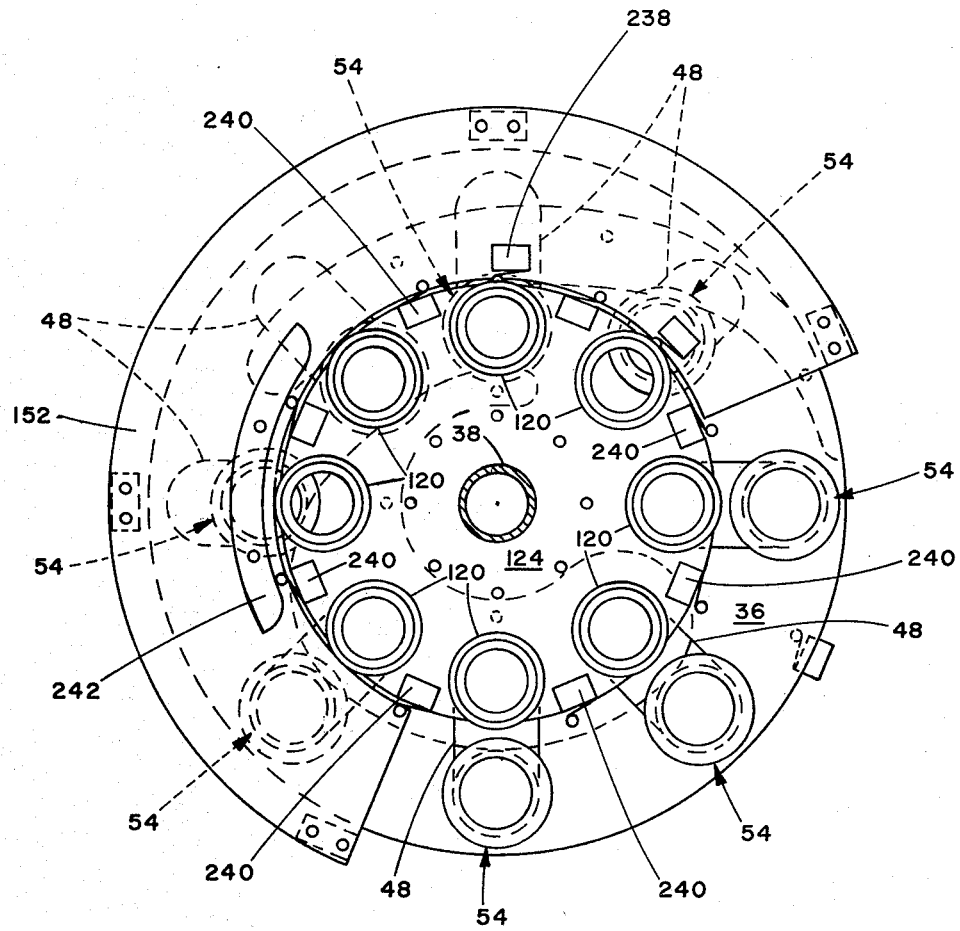
FIG. 4 is an enlarged, schematic, fragmentary view illustrating the path of the article receiving portions or lower egg halves as they are displaced in an arc by the rotatable carrier disk and receivers.

The carrier assembly 20 includes a driven disk 36 secured to a shaft 38 for rotation about a vertical axis, FIG. 4. The carrier disk 36 is driven by a chain 42 which extends about the periphery of and engages teeth or pins secured to the disk 36. Chain 42 is driven by motor 44 through a chain and sprocket driving arrangement 46.

The carrier disk 36 is provided with eight radially extending slots 48, each slidably mounting a receiver 54 for receiving a lower egg half. The receiver 54 is generally a cup-shaped cylinder 50, having an upper flange 56, slidable within a slot upon disk 36. Within the receiver 54 is a ringlike member 58 biased upwardly by springs 60 for supporting the lower end of a lower egg half 62. Preferably, the inner diameter of the carrier peripheral wall corresponds substantially in size to the outside diameter of the container lower egg half 62. The springs 60 provide some resiliency to the container lower egg halves to permit movement relative to the receivers except in certain zones, as will be later described.

Figure 14:
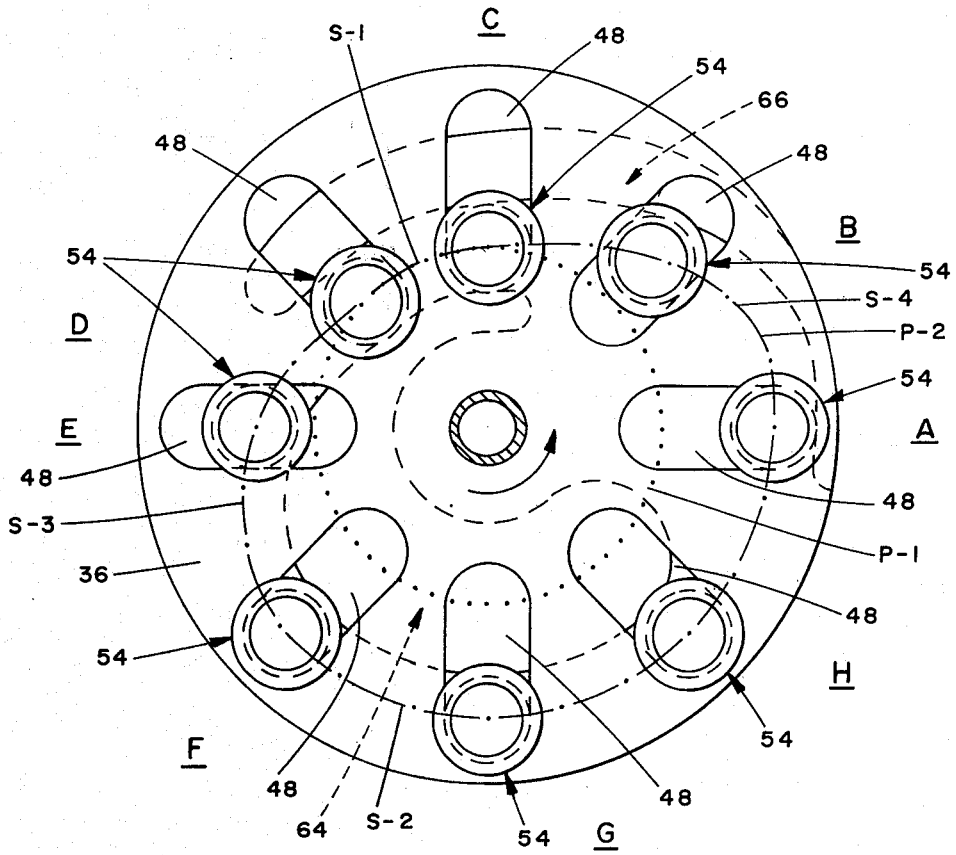
FIG. 14 is a view similar to FIG. 4 illustrating the various operating zones and the cams for transferring the receivers radially of the axis of the rotation.

As each receiver 54 is displaced by rotary disk 36, it is moved within a slot 48 so as to follow the path P-2, FIG. 14. Path P-2 includes a first segment S-1 which coincides with a circular path P-1, a second segment S-2 which coincides with the diameter of a circle concentric with and spaced outwardly of path P-1, and two arcuate segments S-3 and S-4 interconnecting segments S-1 and S-2. Loading of the container egg lower half 62 with an article will take place when the receiver 54 is in the segment S-1 of path P-2, which coincides with circular path P-1. As the receiver rotates counterclockwise, FIG. 14, a cam 66 shifts the lower egg half 62 and receiver 54 from segments S-2 to segment S-1 of path P-2. After loading of an article in the lower egg half 62 and upon continued rotation of disk 36, cam 64 shifts the article, the lower egg half and receiver 54 from segment S-1 to segment S-2 of path P-2 to receive a cover or upper egg half 70 from dispensing assembly 29 for closing the container. After receiving a cardboard cylinder 72, the closed container is ejected from path segment S-2. The receiver again receives another lower egg half 62 from dispenser assembly 24. The cams 64 and 66 are supported by the base plate 68, and lie in the same plane above the plate 68 and below the driving carrier disk 36.

Referring particularly to FIGS. 1–3 and 5, the operation of the assembly 28 for transferring or dispensing a lower egg half into a receiver 54 will now be described. An elongated, vertically disposed member 74, which may be of generally tubular construction, serves as a supply hopper for housing a plurality of the lower egg halves 62. The lower egg halves 62 are in nested relation with the lower peripheral edge of the lowermost egg half being supported by an escapement mechanism which includes fingers 76, 78. A clamping mechanism 80 initiates removal of the lowermost egg half 62 from hopper 74 and releases the lower half permitting it to be positioned in the receiver 54.

Finger 76 of the escapement is supported upon and pivots relative to a bracket 82. A fluid cylinder 84 has one end pivoted to a bracket 86 while the opposite end of the cylinder is pivoted to the finger 76. Finger 78 is secured generally at a right angle to a lever 88 which depends from and is pivotably supported by a bracket 90. Lever 88 also pivotably supports a rod 92 which has one end passing through an opening, not shown, in bracket 90. A spring 94 encompasses the rod 92 and biases the finger 78 to the left, FIG. 5, to support one side of the lowermost egg half 62. A cam surface or roller 96 is provided adjacent the juncture of the finger 78 and the lever 88.

The clamping mechanism 80 comprises a plate 98 having a fixed jaw 100 and a jaw 102 pivotably mounted upon the plate 98. A fluid cylinder 104, having one end pivoted to plate 98 and the opposite end pivoted to jaw 102, controls the opening and closing of the jaw 102. The entire clamping mechanism 80 is pivotably supported by a bracket, not shown, at the upper end of the plate extension arm 106, and the elongated rod pivots the entire clamp mechanism 80 between a first position, where the jaws can engage and grip a portion of the peripheral wall of the lower egg half 62, and a second position (to the left of FIG. 5) permitting the egg half to fall in the receiver 54. As the jaws 100, 102 are displaced upwardly by rod 108 to grip the lower egg half 62, the surface 110 of plate 98 engages roller or cam 96 and rotates the lever 88 about pivot 112 moving finger 78 out of the way to permit egg half 62 to be gripped by jaws 100, 102.

Figure 5:
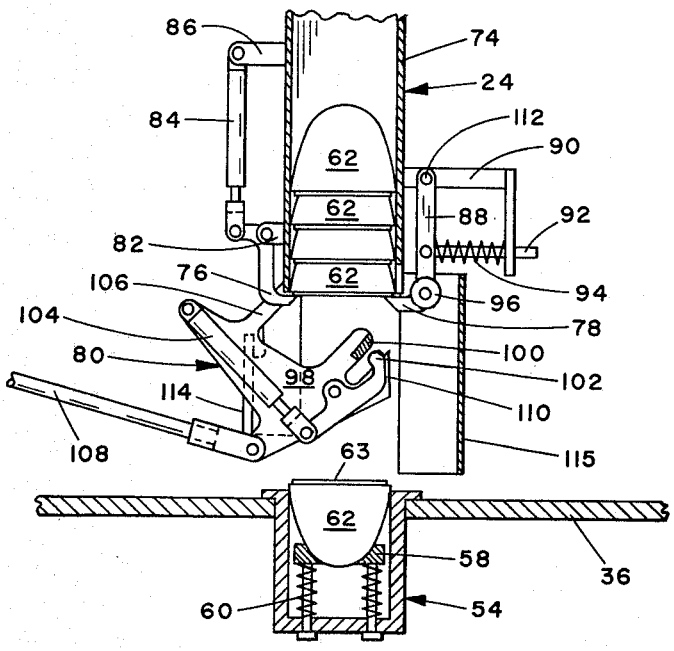
FIG. 5 is a fragmentary, side elevational view, partly in section, of the mechanism for transferring sequentially the lower egg halves from a hopper to receivers and the rotatable carrier disk.

The clamp 80 normally is positioned to the left of the FIG. 5 position and the fingers 76, 78 are positioned as shown. When an egg lower half 62 is to be deposited in or transferred to a receiver 54 supported by rotating disk 36, the rod 108 moves the open jaws 100, 102 vertically while surface 110 engages roller 96 to move the finger 78 to the right. Removing finger 78 permits the unsupported side of the lower egg half drop down slightly with the jaw 100 being positioned within the lowermost one of the stack of nested egg halves 62. Substantially simultaneously, cylinders 104, 84 are actuated such that jaws 100, 102 grip the egg half and finger 76 moves to the left permitting clamp 80 to remove the lowermost egg half from the hopper 74 while initiating 180° rotation of the egg half. As the clamp starts to move away from the hopper 74, fingers 76 and 78 are urged inwardly by cylinder 84 and spring 94, respectively, to again support the next lowermost egg half 62. After approximately 90° movement of the clamp 80 and egg half, the side of the egg half opposite the clamp side abuts the bumpers 114 and the cylinder 104 releases the jaw 102 permitting the egg to free fall while rotating another 90° before dropping into a passing receiver 54. Guide 115 serves to contain the egg half 62 as it is falling and rotating. The lower end of hopper 74 and the clamp 80 are properly elevated above the receiver 54 to permit 180° rotation and proper location of the egg half within the receiver. The movement of rod 108 is controlled in timed relation with the displacement of the receivers beneath the dispensing assembly 28 in a conventional manner through a crank arm 116 and chain drive mechanism 118 driven by motor 44.

The loading assembly 26 is provided for depositing articles within receivers 54. This assembly includes a plurality of loading tubes 120, one for each receiver 54, and a like number of rams 122. The eight loading tubes 120 are equally spaced in a circular path which coincides with the circular path P-1. The loading tubes 120 extend through openings in a circular support plate 124 such that the lower ends of the tubes 120 are flush with the lower surface of plate 125. The upper end of each of the tubes 102 is beveled or tapered for locating both an entering article and a ram 122. The plate 124 is secured to disk 36 for rotation therewith.

Figure 6:
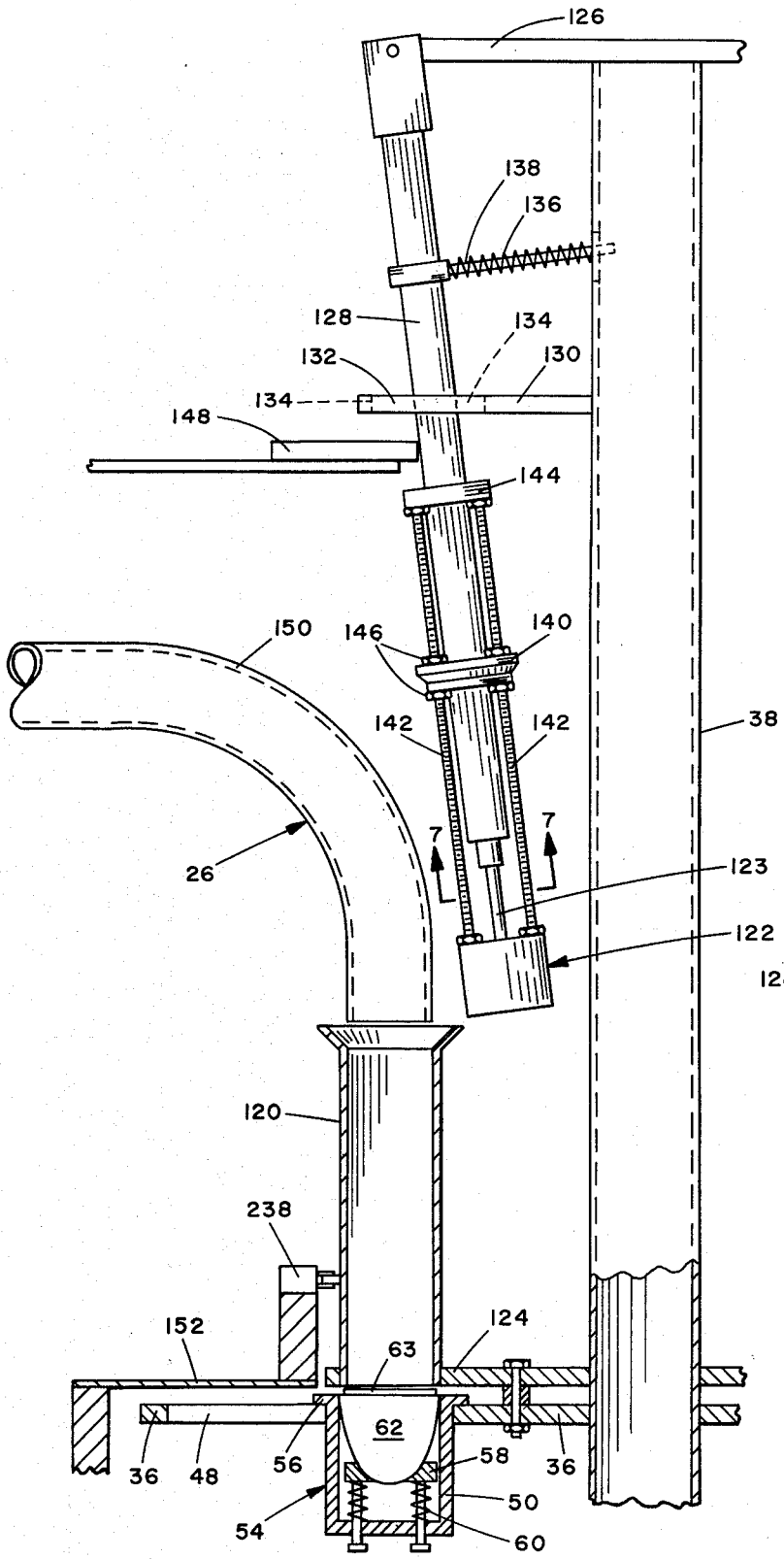
FIG. 6 is an enlarged, fragmentary, side elevational view, partly in section, of the mechanism for directing an article to a lower egg half and a pivotably mounted ram for forcing an article from an article loading tube into a lower egg half.
Figure 7:
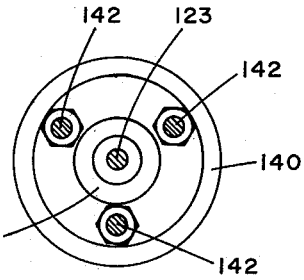
FIG. 7 is a sectional view of the ram taken along line 7—7 of FIG. 6.

Also secured for rotation with shaft 38, disk 36 and plate 124 is a spider 126 which supports the rams 122. Referring particularly to FIGS. 1 and 6, each ram 122 is supported by the rod 123 of an elongated fluid cylinder 128 which depends from and is pivotably supported by the spider 126. As shown most clearly by FIGS. 1 and 6, each ram 122 and cylinder 128 normally is retained in a vertical plane with the axis of each aligned with the vertical axis of a loading tube 120 positioned therebelow. A second spider member 130 is secured to shaft 38 in a plane spaced below and parallel to the spider 126. The member 130 is provided with a radially extending arm for each of the eight fluid cylinders 128, and each arm defines an elongated slot 132 for slidably receiving a cylinder 128. The shoulders 134 of slot 132 permit the lower portions of the cylinders 128 and rams 122 to move inwardly in a plane radially of the axis of shaft 28, between the positions shown by FIGS. 1 and 6. The shoulders forming slot 132 also limit movement of the ram and cylinder in other directions.

Normally each piston 128 and ram 122 is maintained in vertical alignment with the axis of a loading tube 120, as shown by FIG. 1, by the shoulders 134 and a spring 136. Spring 136 encircles a rod 138 and urges the ram from the FIG. 6 position to the FIG. 1 position. The outer diameter of each ram corresponds substantially in size to the internal diameter of the loading tubes 120.

Figure 13:
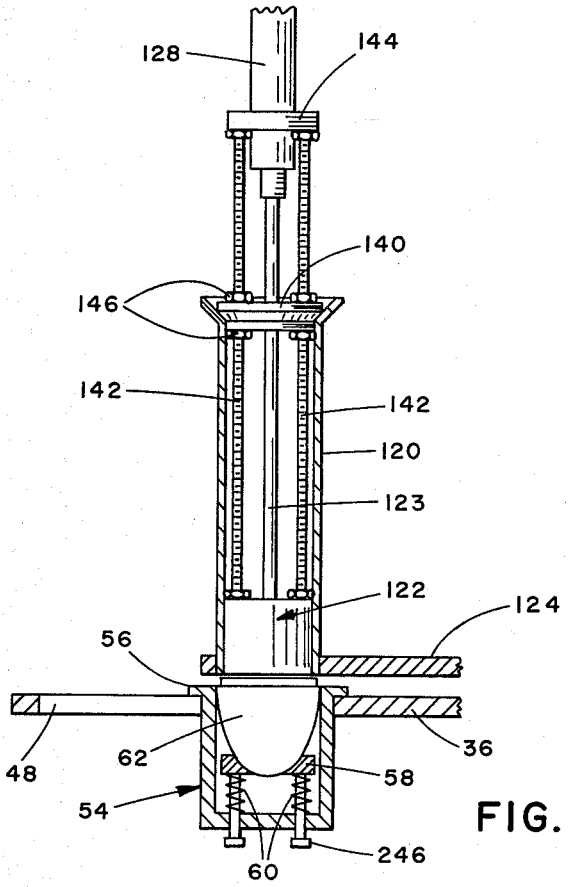
FIG. 13 is a fragmentary, side elevational view, partly in section of a loading tube having a ram positioned flush with the bottom of the carrier plate.

A collar 140 is adjustably mounted and slides relative to the cylinder 128 outer diameter to limit the downward stroke of the ram such that the lower edge surface of the ram 122 is flush with the lower surface of carrier plate 124, FIG. 13. Threaded rods 142 are secured to collar 144 and ram 122, and fasteners 146 permit adjustment of collar 140 axially of fluid cylinder 128.

Normally, each of the eight rams 122 is positioned above and axially aligned with a fluid cylinder 128, a loading tube 120, and a receiver 54 located below the plate 124. To load articles in tubes 120, each ram 122 must be moved to the FIG. 6 position as it passes the article loading station. A fixed cam 148, FIGS. 3 and 6, is provided for this purpose. As the disk 36, plate 124, and spider 126 rotate as a unit, each fluid cylinder 128 engages cam 148 and is pivoted to the FIG. 6 position to permit an article to be conveyed through conduit 150 and into a loading tube 120. The lower edge of conduit 150 is located slightly above the tapered upper end of a loading tube positioned at the loading station.

After air pressure, from a suitable source, forces one or more articles through conduit 150 and into a loading tube 120, the fluid cylinder is actuated, as will be later described, and the ram pushes the article out of the loading tube and into the lower egg half 62 of the container. Articles may be directed through loading conduit 150 by air pressure at required intervals in a conventional manner, or as disclosed in U.S. Pat. No. 3,707,825.

Continued arcuate displacement of an egg lower half having an article therein results in cam 64 initiating movement of lower egg half 62 and receiver 54 in slot 48 from path P-1 towards path P-2. As the receiver and egg half 62 move from beneath loading tube 120 and plate 124, they move under plate 152, FIG. 6, which is substantially flush with the upper peripheral surface of the lower egg half 62 and serves to retain the article within the egg half.

Upon being shifted to path P-2 by cam 64, the lower egg half 62, having an article therein, is positioned to receive the upper egg half 70 from dispensing assembly 28.

Figure 8:
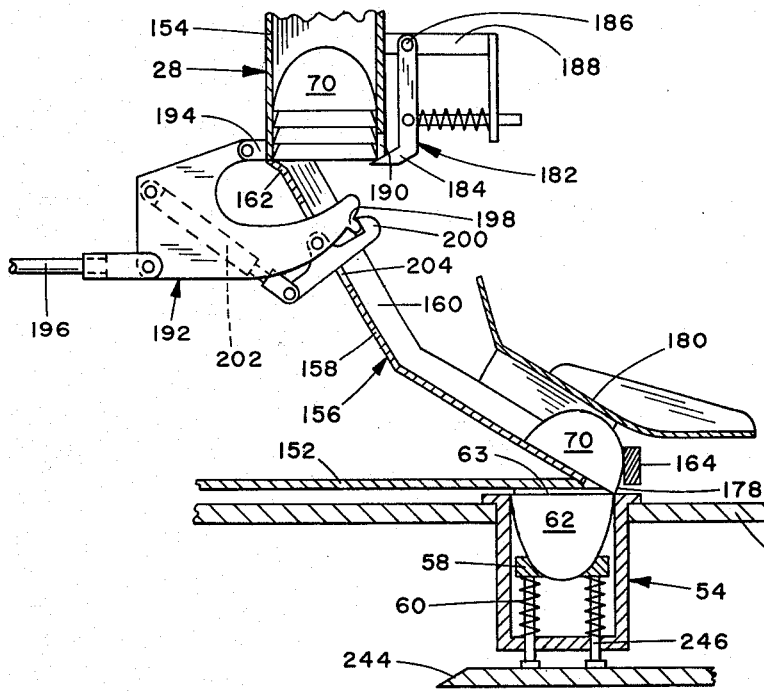
FIG. 8 is an enlarged, fragmentary, side elevational view partly in section, of the apparatus for directing an upper egg half or cover unit from a hopper, down an incline, and into locking engagement with a lower egg half having an article therein to form a container.

The assembly 28 includes a vertically disposed tubular hopper 154, FIGS. 1, 3, and 8, for retaining in stacked or nested relation, a plurality of the egg upper halves 70. A slide 165 having a base 158 and upstanding side walls 160 includes an upper end portion mounted adjacent the lower end of the hopper 154, and angles downwardly to contact the plate 152. The upper end of the slide 156 is provided with a ledge 162, for supporting one peripheral side portion of the lowermost upper egg half 70, while the lowermost end portion of the slide 156 is normally closed by a gate 164, FIGS. 8–10.

The gate 164 is pivoted at 166 adjacent one end upon a bracket 168 secured to one of the side walls 160. The opposite end of the gate normally rests against a stop or bumper 170 secured to the other side wall 160. A spring member 172 has one portion coiled about a shaft 174 while the opposite end is attached by a fasterner 175 to the gate 164. The gate 164 retains an upper egg half 70 with a portion 179 overhanging the end of the slide 156 and positioned slightly below the lowermost surface of the end of plate 152, see FIGS. 8 and 9. As shown most clearly by FIG. 8, the upstanding peripheral locking flange 63 of a lower egg half 62 engages the overhanging, lowermost portion 178 of the upper half 70. As the carrier disk 36 continues to rotate the receiver 54 and egg lower half 62 in path P-2, the lower half 62 pulls the egg upper half 70 which overcomes the biasing force of the spring 172 and opens gate 164 as the upper half 70 moves off of the slide 156. As the container halves 62, 70 continue to rotate in path P-2, cam 180 forces the egg upper half 70 downwardly upon the flange 63 of lower half 62 thus attaching the two halves together forming a closed container. The flange is received within the upper egg half 70 with a snap fit.

In addition to the ledge 162, the lowermost egg half 70 in hopper 154 is supported by spring biased latch 182, FIG. 8. The latch 183 includes a pair of spaced parallel fingers 184 pivoted at 186 upon a bracket 188 and angled downwardly with respect to the lower end of the hopper. The lower edge of the tubular hopper 154 is provided with a narrow slot 190.

A clamp 192 is pivotably mounted adjacent the slide ledge 162 upon a bracket 194. The clamp includes a first jaw 198 and a second jaw 200 pivotably mounted relative to the jaw 198 and controlled by fluid cylinder 202. The clamp is moved by rod 196 through a central slot 204 in the base 158 of slide 156, FIG. 8, and with the jaws 198, 200 open on the upward travel to a position for engaging the lowermost one of the stacked egg halves 70 in hopper 154. The jaws 198, 200 pass through slot 190 in the hopper. The jaws close upon actuation of fluid cylidner 202 and grip the bottom rim of the lowermost one of the stacked upper egg halves 70. When the downward stroke of the clamp 192 is initiated by rod 196, the lowermost egg half 70 rotates downwardly moving the spring biased latch 182 outwardly. As soon as the fingers clear the clamped upper egg half 70, the latch 182 springs back to catch and support the next lowermost egg half of the nested stack of upper egg halves. Fluid cylinders 202 opens the jaw 200 when the clamped egg half 70 reaches the slide base 158 and the clamp continues to move through the slot and the egg half 70 is free to move down the slide 156 and abut the closed gate 164.

The rod 196, which rocks the clamp 192, is controlled by a crank arm 206 which, in turn, is driven in a conventional manner through a chain drive arrangement 208 from motor 44.

The fluid cylinder 202, FIG. 8, as well as the fluid cylinder 84, FIG. 5, may be controlled in a conventional manner to open and close the jaws of clamps 192 and 80, respectively, at the proper times. Alternatively, the clamp jaws could be controlled by means of a mechanical linkage or other apparatus which is timed with the rotation of the receiver 54.

Continued displacement of the closed container, having an article therein, along a path P-2 brings the container to an assembly 30 where a cardboard cylinder 72 is attached to the container.

Figure 11:
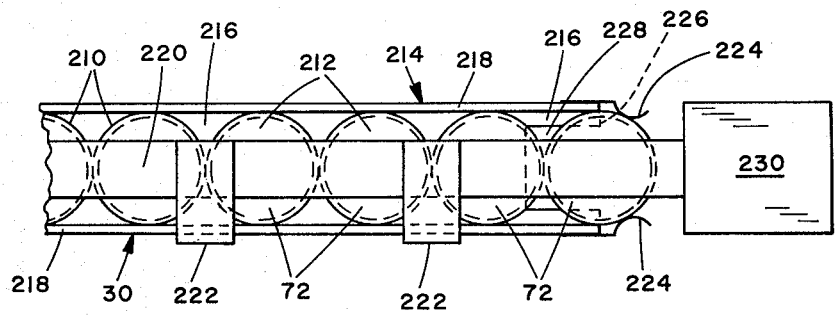
FIG. 11 is a fragmentary, top plan view of an inclined cardboard cylinder hopper assembly provided with a cam for attaching the cardboard cylinder to the containers having articles therein.
Figure 12:
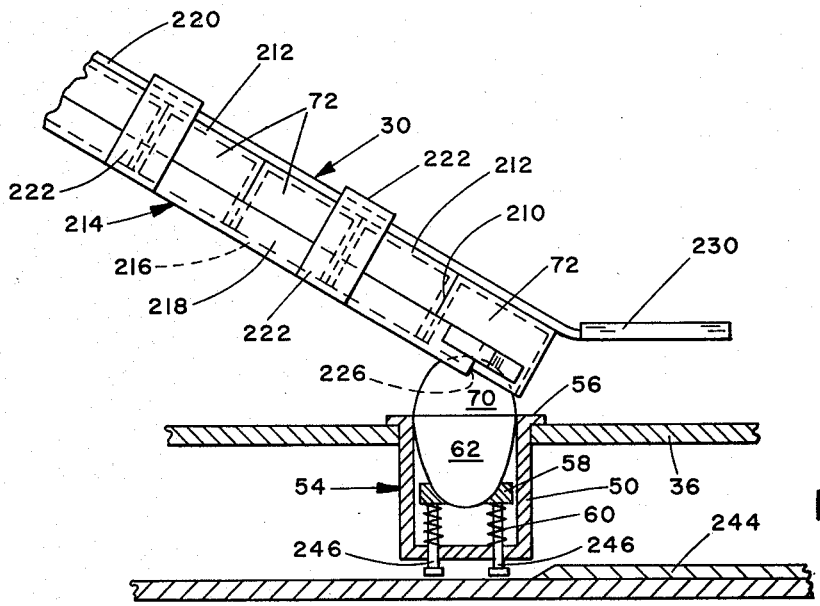
FIG. 12 is a fragmentary, side elevational view of the cardboard cylinder chute with a cylinder being positioned at the lower end thereof prior to being forced upon and secured to a closed container.

Referring to FIGS. 2, 3, 11, and 12, the cardboard container illustrated is generally cup shaped having a peripheral wall 210 and a closed end member 212. A plurality of the cylinders 72 are positioned open end down in abutting relation, as shown by FIGS. 11, 12 within a supply chute 214. The chute 214 is inclined and includes a bottom ramp or slide 216, spaced side walls 218 slightly wider than the diameter of the cylinders 72 and an upper elongated guide 220 supported by brackets 222 for retaining the cylinders 72 upon the ramp 216. Cylinders 72 are fed into the upper end of the chute.

Spring type fingers 224 are secured to the spaced side walls 218 at the lower end of the chute for positioning the lowermost cylinder 72 with a substantial portion overhanging the lower edge portion 226 of ramp 216. Note that a substantial portion of the lower end of ramp 216 has been removed, FIG. 11, defining an enlarged slot or opening 228 for permitting the upper portion of the closed egg container to move into contact with the lowermost cylinder 72. See FIG. 12. The egg container moving against a cylinder 72 overcomes the spring pressure applied by fingers 224 and the cylinder is removed from the chute. The fingers 224 spring back to arrest the sliding movement of the next lowermost cylinder in the chute as the cylinder moves down the ramp 216.

A cam 230, which is secured to or may be continuation of elongated guide 220 forces the cardboard cylinder 72 down upon small lugs, not shown, on the container egg lower half 62 locking the cardboard to the container as the container progresses along path P-2. The diameter of the egg container substantially corresponds to the inner diameter of the cylinder peripheral wall 210.

The container having the cylinder 72 attached thereto is carried to a location wherein air pressure from a nozzle 232 ejects the unit from the receiver 54 and it travels down a ramp 234, FIGS. 1 and 2, to a receptacle or conveyor, not shown.

In operation of the apparatus, the carrier disk 36, plate 124, supporting the loading tubes 120, and spider 126, supporting the rams 122 rotate in unison, continuously, being driven by motor 44. The container receivers 54 also are carried by rotating disk 36. It is to be noted that the receivers, loading tubes 120 and rams 122 are equal in number, and while eight have been illustrated on the drawing, the number may be varied depending upon the desired production, space limitations, etc.

While the operation will be described with respect to the paths followed and the various operations performed in packaging an article with respect to a single container receiver 54, it is to be understood that the dispensing assemblies 24, 28, article loading assembly 26 and cylinder loading assembly 30 perform their functions as each of the eight receivers 54 pass the various work zones. In a preferred embodiment, the speed of the apparatus is such to obtain 60 to 70 packages per minute with the carrier disk 36 rotating approximately 7.5 revolution per minute.

Figure 9:
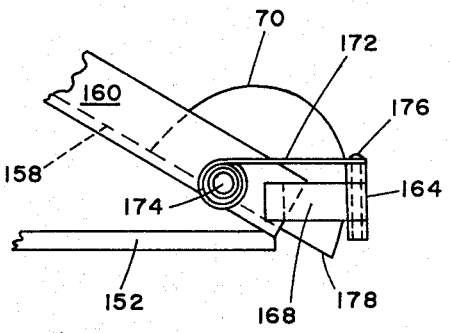
FIG. 9 is an enlarged, schematic, side elevational view of a gate for temporarily positioning the upper egg half prior to engagement by the lower egg half.
Figure 10:
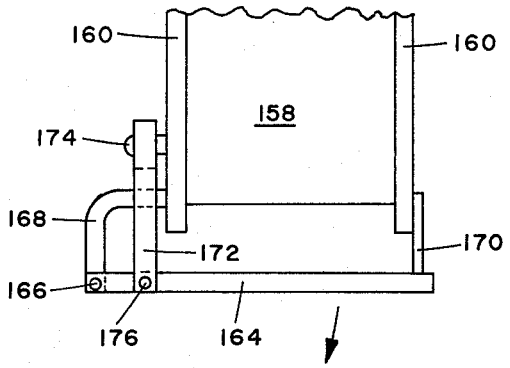
FIG. 10 is a top plan view of the apparatus of FIG. 9.

An empty receiver 54 traveling in segment S-2 of path P-2 receives the lower egg half 62 of a container from the dispensing assembly 24 at zone A, FIG. 14. At this location, the outer circumferential periphery of the egg lower half 62 rests above the top receiver flange 56, as shown by FIG. 5, due to springs 60. As a receiver 54 and lower egg half 62 progress, the forward edge 236 of cover plate 152 is curved and serves as a ramp 236 urging the egg lower half downwardly into the receiver 54, as shown by FIGS. 6, 9 and 13, such that only the locking flange 63 projects above the upper surface of receiver flange 56. The ramp 236 aligns with the egg lower half 62 and slowly depresses it into the receiver 54 against the springs 60 as the carrier disk 36 rotates.

Cam 66 moves the receiver 54 inwardly at zone B, along segment S-4 of path P-2. Also, at approximately zone B, a ram 122 axially aligned with the receiver 54 is camed inwardly, by cam 148, as shown by FIG. 6.

At zone C, the receiver 54 is traveling in segment S-1 of path P-2 and is axially aligned with a loading tube 120. Air pressure forces an article to be packaged through conduit 150 at least into the loading tube. Air pressure for loading an article is controlled by a microswitch 238, FIGS. 4 and 6, which is mounted upon a plate 152 and adapted to be engaged by and actuated each time a loading tube 120 reaches the zone C and is positioned beneath the end of conduit 150.

Continued rotation of disk 36, plate 124, and spider 126 permits the cylinder 128 to ride off of cam 148 and permits spring 136 to pivot the ram 122 back to a position above and axially aligned with the loading tube 120. Mounted for rotation with the disk 36, plate 124, and spider 126 are eight equally spaced microswitches 240, FIGS. 3 and 4, each switch controlling the operation of a ram 122. An elongated cam 242 is provided in approximately zone D, and as the loading tube having an article therein moves from the loading zone B, the associated microswitch 240 contacts cam 242 actuating the fluid cylinder 128 to move the ram 122 downwardly into the loading tube 120 positioned directly therebelow. The ram moves downwardly until the lower end is substantially flush with the lower surfaces of plates 124 and 152 and the lower end of the loading tube thus forcing the article completely from the loading tube 120 and into the container lower egg half 62 supported in receiver 54. The ram 122 remains down until the microswitch contact rides off the elongated cam 242. This permits the cam 64 to move the receiver 54 along segment S-3 of path P-2 from beneath the ram and underneath the plate 152 prior to withdrawal of the ram from the loading tube 120. The camming action of the receiver 54 is in zone E which, to a certain extent, overlaps zone D.

An upper egg half is always positioned upon the slide 156 abutting gate 164, as shown by FIG. 9. After the receiver 54, supporting the lower egg half 62 and an article, have been cammed to segment S-2 of path P-2 the continuously moving lower egg half 62 emerges from beneath plate 152 and engages the lower edge of the egg upper half 70 in zone F, as shown by FIG. 8. Cam 180 forces the upper egg half 70 upon the lower egg half 62. The dispensing assembly 28 is timed with the rotation of carrier disk 36 such that as the egg upper half positioned upon slide 156 is removed through gate 164, the clamp 192 transfers another egg upper half from the hopper 154 to the slide 156.

Continued rotation of the receiver 54 and closed egg halves 62, 70 brings the closed container into contact with a cardboard cylinder 72, FIG. 12, which is pulled from chute 214 and forced into locking engagement by cam 230 upon the container at zone G.

As the container and cardboard cylinder progress to zone H, they are ejected from the receiver 54 and travel down a ramp 232. A mechanical apparatus, rather than air pressure, may be provided for removing the container and cardboard cylinder from the receiver. The receiver 54 continues to rotate in segment S-2 of path P-2 and receives another lower egg half 62 as it passes beneath dispensing assembly 24.

The springs 60 in each cylinder 50 must be inoperative such that ring member 58 provides a rigid support for the container portion or portions in the article loading zones D, E, F, and G. To provide rigid support, cams 244, as shown for example by FIG. 8, are provided at each of zones D-G. The cams 244 prevent downward movement of the rods 246 which are secured to ring 58 and project through openings in the bottom of the cup-shaped cylinder 50. In the embodiment illustrated, a spring 60 encircles each rod 246.

While the particular container portions illustrated on the drawing comprise an egg shaped container including upper and lower halves, containers of other sizes and configurations could be utilized. In stacking the egg halves, as in hoppers 74 and 154, in nested relation, the halves tend to stick together because of their shape and the lowermost egg half in each hopper may not drop by gravity. Therefore, a clamp is provided at each hopper for positively gripping and initiating arcuate displacement of the lowermost egg half of each hopper, thus freeing the lowermost egg half from the remaining nested egg halves.

What is claimed is:

1. An article packaging apparatus comprising, conveyor means mounted for rotation about a vertical axis, a plurality of upwardly opening article receiving means carried by said conveyor means and continuously movable from work zone to work zone along an endless path, means for sequentially displacing radially of said axis of rotation each of said plurality of article receiving means, upon rotation of the conveyor means, for directing said article receiving means along said endless path between work zones spaced unequal distances radially from said axis of rotation, and further including means for feeding sequentially container lower portions to said article receiving means at a first work zone, and means for sequentially loading articles into said container lower portions.

2. an article packaging apparatus as recited in claim 1, said means for sequentially loading articles into container lower portions including a plurality of spaced, tubular means displaceable in a circular path about said axis upon rotation of said conveyor means, a plurality of plunger means cooperating with said tubular members, a plunger means being vertically spaced above, displaceable with, and aligned with each of said tubular members, means for actuating said plunger means for forcing articles through said tubular members and into said container lower portions during rotation of said plurality of plunger means and said conveyor means, and means for sequentially directing articles to said tubular members as they advance past an article feeding zone.

3. An article packaging apparatus as recited in claim 2, wherein said article receiving means are sequentially shiftable relative to said rotatable conveyor means between a first location beneath said lower portion feeding means and a second location for receiving articles within said container lower portions, said first and second locations being spaced unequal distances from and perpendicular to said vertical axis.

4. An article packaging apparatus as recited in claim 3, and further including means for feeding container upper portions for engagement with said container lower portions and for subsequently closing said container lower portions.

5. An article packaging apparatus as recited in claim 4, wherein each of said means for feeding a lower container portion and said means for feeding an upper container portion includes a supply hopper maintaining a supply of container portions in downwardly opening, nested relation, and means, including a clamp, for removing the lowermost container portion from each of said supply hoppers.

6. An article packaging apparatus as recited in claim 1, wherein said means for feeding container lower portions includes a supply hopper, for maintaining a plurality of container lower portions in downwardly opening, nested relation, and means for removing the lowermost container lower portion from said hopper and rotating the lowermost container portion 180° before being deposited in one of said plurality of articles receiving means.

7. An article packaging apparatus as recited in claim 1, wherein each of said plurality of upwardly opening article receiving means inclues a cup-shaped receptacle, and resilient means within said receptacle for supporting a container lower portion.

8. An article packaging apparatus as recited in claim 1, wherein said endless path includes one arcuate segment having a first radius of curvature at a first work zone and another arcuate segment having a second radius of curvature different from said first radius of curvature at an adjacent work zone.

9. In the packaging of hosiery articles carrier means supporting a plurality of spaced, article receiving container portions for displacement along a first endless path having an arcuate portion, a plurality of article loading means displaceable along a second endless path having an arcuate segment aligned with said first endless path arcuate portion, each of said plurality of loading means including a receiver tube and a ram means, the receiver tube and ram means of each loading means being continuously displaceable along said second endless path, means simultaneously displacing said article receiving container portions along said first endless path arcuate portion and said receiver tubes along said second endless path arcuate segment, feeding means for directing hosiery articles sequentially to the receiver tubes in a first work zone, and means for sequentially actuating said ram means for forcing articles from the receiver tubes into the article receiving container portions upon displacement of the loading means and container portions through a second work zone.

10. In the packaging of hosiery articles as recited in claim 9, said means simultaneously displacing said article receiving container portions and said receiver tubes including a receiver tube supporting means provided with a plurality of openings therein, the lowermost ends of said receiver tubes being secured within said openings and flush with the lowermost surface of said supporting means, each of said loading means further including means for limiting the stroke of said ram means such that the lowermost surfaces of said ram means are flush with the lowermost ends of said receiver tubes.

11. An article packaging machine including support means, and endless conveyor means mounted upon said support means for continuous displacement from work zone to work zone along an endless path, said endless path including a first arcuate portion having a first radius of curvature at a first work zone and a second arcuate portion having a second radius of curvature at an adjacent work zone, packaging portion receiving means carried by said endless conveyor means, means selectively displacing said package portion receiving means between said first and second arcuate portions of said endless path as said package portion receiving means progress from work zone to work zone, feeding means proximate said conveyor means depositing package portion receiving means upon said conveyor means, article feeding means, article loading means mounted for continuous displacement in a circular path having a radius of curvature aligned with said first radius of curvature for receiving articles from said article feeding means and directing articles to said package portion receiving means, means closing said package portion receiving means, and means for removing the package portion receiving means having articles therein from said conveyor means.

12. An article packaging machine as recited in claim 11, said article loading means including a plurality of vertically disposed loading tubes, a plurality of loading rams, and means for supporting said tubes and said rams for displacement with said endless conveyor means, means aligning said package portion receiving means beneath said loading rams prior to feeding articles into the loading tubes, and means for sequentially actuating each of said plurality of rams for forcing articles through the loading tubes and into the said package portion receiving means upon displacement of said plurality of rams about said vertical axis.

13. An article packaging machine as recited in claim 11, said feed means proximate said conveyor means for depositing package portion receiving means upon said conveyor means including, a supply means for releasably supporting in vertically stacked, nested relation, a plurality of downwardly opening package portion receiving means, means for clamping the lowermost of the plurality of stacked package portion receiving means and pivoting the package portion receiving means prior to depositing said packaging portion receiving upon said endless conveyor means.

14. An article packaging machine as recited in claim 13, wherein said clamping means pivots to rotate the package portion receiving means approximately 90°, and upon release by said clamping means, said package portion receiving means rotates approximately another 90° before being received by said conveyor means.

15. An article packaging machine as recited in claim 11, said means closing the packaging portion receiving means including supply means for one or more closure portions, clamp means sequentially removing closure portions from the supply means, means sequentially positioning closure portions removed from said supply means in a predetermined position for engagement by said package portion receiving means carried by said endless conveyor means, and for sequentially positioning said closure portions upon said package portion receiving means.

16. The method of packaging articles comprising: conveying an article receiving portion of a container along a first arcuate segment of an endless path, directing an article loading member in a circular path remote to the first arcuate segment, directing the article receiving portion from the first arcuate segment to a second arcuate segment of the endless path vertically aligned with portions of the circular path, vertically aligning the article receiving portion and the rotating loading member, feeding an article into the rotating loading member after displacement of the receiving portion to the endless path second arcuate segment, forcing the article from the rotating loading member into the aligned article receiving container portion, conveying the article receiving portion and article from the second arcuate segment to a third arcuate segment of the endless path remote to the loading member circular path and the second arcuate segment closing the article receiving portion, and removing the containers having articles therein from the endless path.

17. The method of packaging articles as recited in claim 16, wherein the article receiving portion engages and pulls a container upper portion along the endless path to completely encompass the article.

18. An article packaging apparatus including conveyor means amounted for rotation about a vertical axis, a plurality of upwardly opening article receiving means carried by said conveyor means and continuously movable from work zone to work zone spaced along an endless path, container portions supported upon selected ones of said plurality of receiving means for receiving articles therein, means for sequentially displacing radially of said axis of rotation each of said plurality of receiving means as said receiving means moves along said path between work zones spaced unequal distances radially from the axis of rotation, and means for ejecting said article container portions from said receiving means at a selected location along said endless path.

19. An article packaging apparatus as recited in claim 18, wherein said conveyor means includes a rotatable carrier means provided with a plurality of radially extending slots for supporting said plurality of upwardly opening article receiving means therein.

* * * * *